US007743513B1

(12) United States Patent
Fisher et al.

(10) Patent No.: US 7,743,513 B1
(45) Date of Patent: Jun. 29, 2010

(54) CHAINSAW TENSIONING DEVICE

(75) Inventors: David B. Fisher, Bowling Green, KY (US); Todd J. Ford, Bowling Green, KY (US)

(73) Assignee: MTD Products Inc, Valley City, OH (US)

( * ) Notice: Subject to any disclaimer, the term of this patent is extended or adjusted under 35 U.S.C. 154(b) by 793 days.

(21) Appl. No.: 11/555,243

(22) Filed: Oct. 31, 2006
(Under 37 CFR 1.47)

(51) Int. Cl.
*B27B 17/14* (2006.01)

(52) U.S. Cl. ..... 30/386; 30/383

(58) Field of Classification Search ..... 30/385, 30/386, 383
See application file for complete search history.

(56) References Cited

U.S. PATENT DOCUMENTS

| | | | | |
|---|---|---|---|---|
| 1,802,129 | A | 4/1931 | Vaccari | |
| 2,296,240 | A * | 9/1942 | Blum | 30/385 |
| 2,532,981 | A | 12/1950 | Wolfe | |
| 3,113,467 | A | 12/1963 | McKenna | |
| 3,194,284 | A | 7/1965 | Walker | |
| 3,232,325 | A | 2/1966 | Hamilton | |
| 3,267,973 | A * | 8/1966 | Beard | 30/386 |
| 3,279,508 | A | 10/1966 | Ehlen et al. | |
| 3,457,970 | A * | 7/1969 | Locati | 30/381 |
| 3,636,995 | A * | 1/1972 | Newman | 30/386 |
| 4,368,597 | A | 1/1983 | Fleckenstein | |
| 4,382,334 | A * | 5/1983 | Reynolds | 30/386 |
| 4,654,972 | A | 4/1987 | Sellmaier et al. | |
| 4,977,708 | A | 12/1990 | Kloft | |
| 5,345,686 | A | 9/1994 | Zimmermann | |
| 5,528,835 | A | 6/1996 | Ra | |
| 5,600,914 | A * | 2/1997 | Tatar | 43/6 |
| 6,148,525 | A | 11/2000 | Mizutani et al. | |
| 6,493,949 | B2 * | 12/2002 | Kondo et al. | 30/386 |
| 6,560,879 | B2 * | 5/2003 | Franke et al. | 30/386 |
| 6,564,459 | B1 * | 5/2003 | Steinbrueck et al. | 30/383 |
| 6,637,286 | B2 | 10/2003 | Friedrich et al. | |
| 6,694,623 | B1 * | 2/2004 | Haughey | 30/386 |
| 6,782,627 | B2 * | 8/2004 | Hermes et al. | 30/386 |
| 7,101,295 | B2 | 9/2006 | Taomo et al. | |
| 7,155,832 | B2 * | 1/2007 | Warfel et al. | 30/386 |
| 7,434,502 | B2 * | 10/2008 | Keeton et al. | 83/816 |
| 2004/0148788 | A1 | 8/2004 | Behbahany | |
| 2006/0016081 | A1 | 1/2006 | Keeton et al. | |
| 2006/0075644 | A1 | 4/2006 | Keeton et al. | |

* cited by examiner

*Primary Examiner*—Hwei-Siu C Payer
(74) *Attorney, Agent, or Firm*—Wegman, Hessler & Vanderburg

(57) ABSTRACT

A chainsaw has a cam lever and cam assembly that can be used to adjust the tension of a guide bar in the chainsaw. Once the tension of the guide bar has been lessened, the guide bar can be moved back and forth by using a chain-tightening knob and tightening mechanism. The movement of the guide bar causes the chain to tighten or loosen on the guide bar.

10 Claims, 11 Drawing Sheets

CHAINSAW TENSIONING DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to a chainsaw having an adjustable guide bar. More particularly, the present invention relates to a device for adjusting the tension of the guide bar of a chainsaw and for adjusting the tension of a chain on the guide bar.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION

Figure 1A:
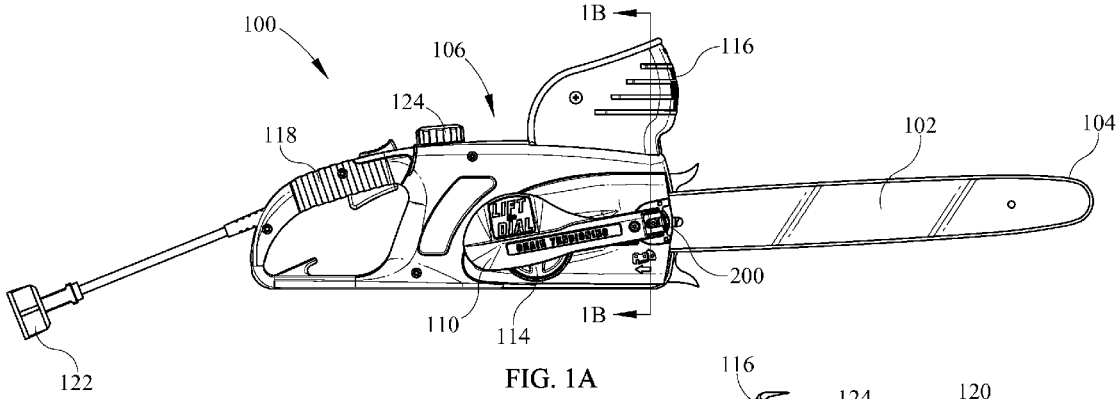
FIG. 1*a* is a side view of an embodiment of the chainsaw of the invention.

While this invention is capable of embodiments in many different forms, multiple embodiments are shown in the figures and will be herein described in detail. The present disclosure is to be considered an exemplification of the principles of the invention and is not intended to limit the broad aspects of the invention to the embodiments illustrated.

Generally referring to the Figures, a chainsaw 100 of an embodiment of the invention has a housing 106, an engine within the housing 106, a guide bar 102 partially enclosed in the housing 106, and an endless cutting chain 104 wrapped around the guide bar 102. The engine drives the chain 104 around the guide bar 102 at a high speed, thereby providing an effective cutting action. Due to wear and tear, the chain 104 on the chainsaw 100 elongates and becomes loose over a period of time. To prevent the chain 104 from coming off the guide bar 102, the guide bar 102 must be moved longitudinally away from the housing 106. To adjust the position of the guide bar 102, the tension holding the guide bar 102 in place must first be lessened.

In one embodiment, the tension of the guide bar 102 can be adjusted using a cam 126, a cam lever 110, and a spring 206 that moves toward or away from the portion of the guide bar 102 contained within the housing 106. In another embodiment, the spring 206 is enclosed in a cam cup 204 that pushes against the guide bar 102. When the cam lever 110 is in a first "closed" position (shown in FIGS. 9, 10, and 14), the spring 206 or cam cup 204 is tight against the guide bar 102 and holds the guide bar 102 in place. When the cam lever is "open" in a second position (shown in FIGS. 11, 12, and 13), the spring 206 or cam cup 204 moves away from the guide bar 102 so that there is little or no tension holding the guide bar 102 in place. In the second position, the guide bar 102 can be moved by a rotatable knob 114 that is positioned below the cam lever 110 and interacts with a gear 140 and tensioning screw 142 that moves the guide bar 102 axially, thereby tightening the chain 104.

Figure 1B:
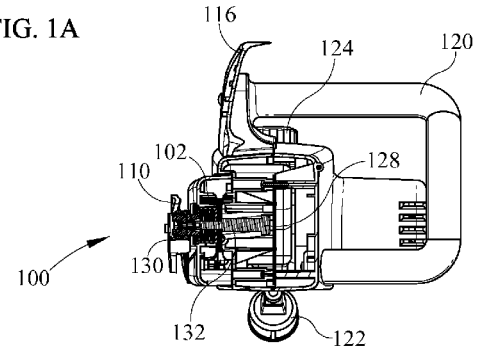
FIG. 1*b* is a cutaway view of the chainsaw of FIG. 1*a* taken along line 1B-1B.

Turning now to FIGS. 1A and 1B, the invention comprises a chainsaw 100 having a guide bar 102 with an endless chain 104 on the edge of the guide bar 102. The guide bar 102 extends from the housing 106 of the chainsaw 100 and can be moved toward or away from the housing 106 in order to tighten or loosen the chain 104 on the guide bar 102 using a cam lever 110, cam cup assembly 200, and adjustable chain-tightening knob 114.

A variety of other parts are also visible in FIGS. 1A and 1B, including a hand guard 116, rear handle 118, front handle 120, and electric plug-in 122. The hand guard 116 is positioned atop the housing 106 and prevents a user's hand from coming in contact with the chain 104 and guide bar 102. The rear handle 118 and front handle 120 are positioned on the rear and side, respectively, of the housing 106. A user can grip the handles 118, 120 with their hands and manipulate its position in order to cut wood or other materials.

In this embodiment of the invention, the chainsaw 100 is powered by electricity, and the electric plug-in 122 can be attached to an extension cord and plugged into an electrical outlet (not shown). In other embodiments, the chainsaw 100 can be powered by battery or by gasoline. The housing 106 of the chainsaw 100 of this embodiment also has an oil cap 124 for a tank or receptacle (not shown) into which oil can be poured.

Figure 2:
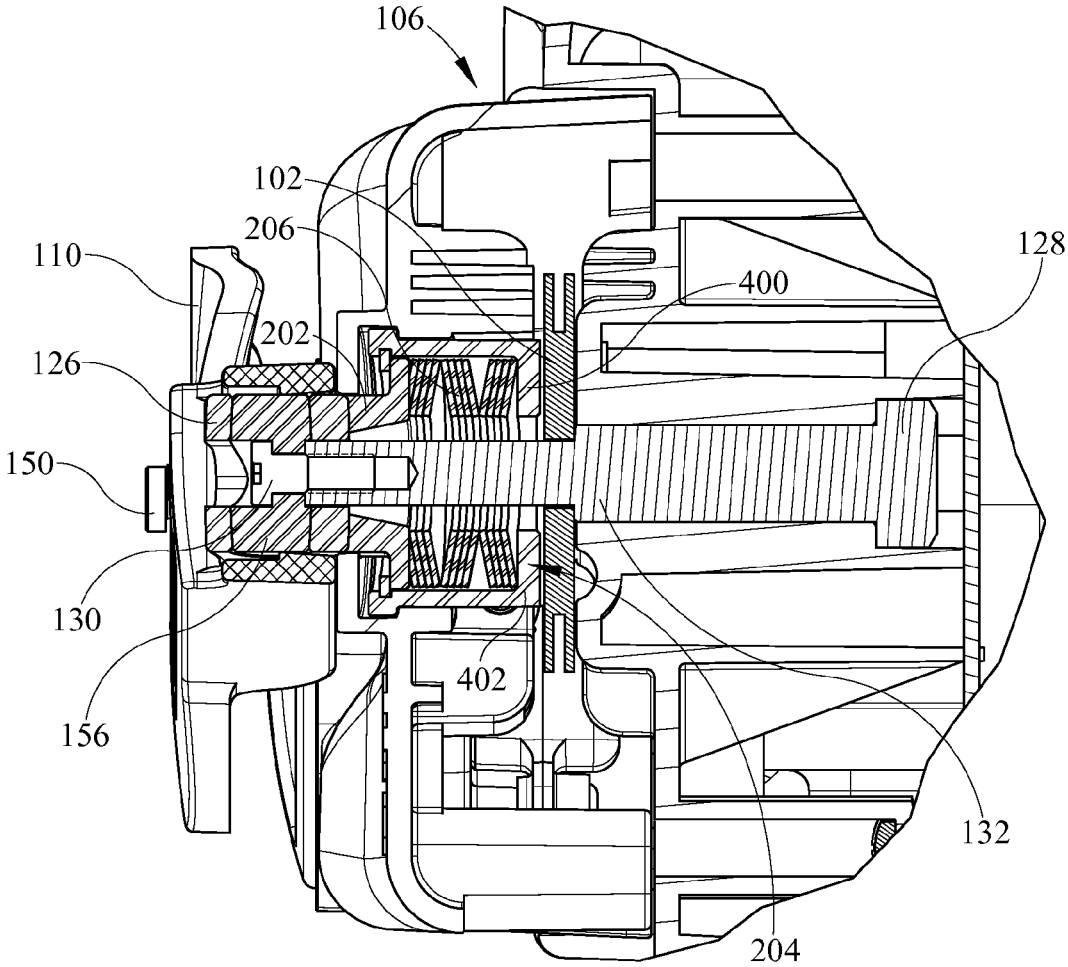
FIG. 2 is a cutaway view of one embodiment of the cam cup assembly and lever of the invention.

FIGS. 1B and 2 show a cutaway view of the components within the housing 106 of the chainsaw 100. The cam lever 110 is positioned outside of the housing 106 and is attached to a cam 126 and cam cup assembly 200. An anchor bolt 128 is also visible in FIG. 1B and FIG. 2. The anchor bolt 128 extends through the guide bar 102, the shoulder 132 of the anchor bolt 128 is adjacent to the guide bar 102. A cam screw 130 inserts into one end of the anchor bolt 128, and the anchor bolt 128 thus holds the guide bar 102 and cam 126 in place. A cam lever screw 150 attaches the cam lever to an elongated portion 148 (see FIG. 8) of the cam 126.

Figure 3:
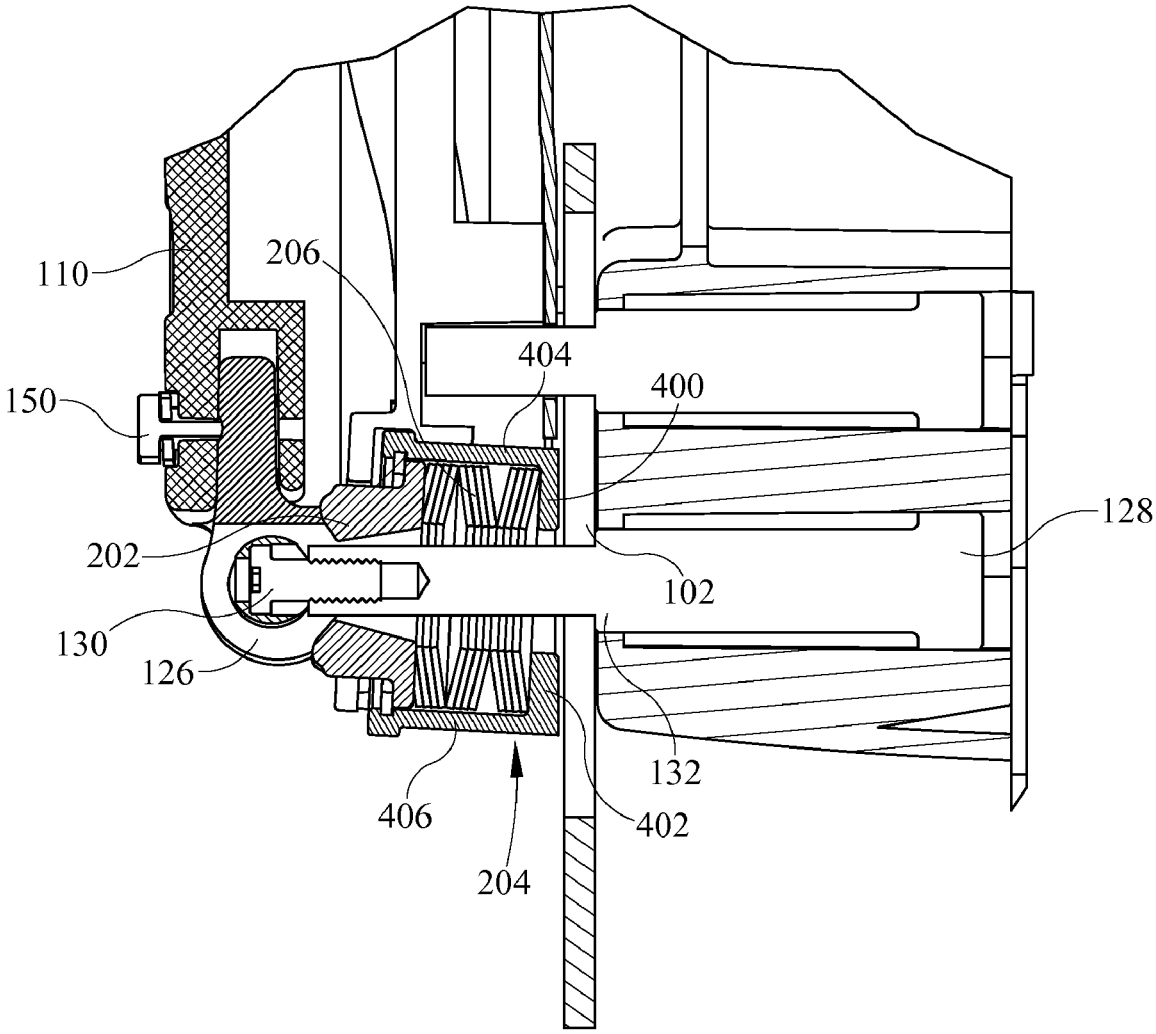
FIG. 3 is a cutaway view of a second embodiment of the cam cup assembly.

Two different embodiments of the cam cup 204 are shown in FIGS. 2 and 3 in which FIG. 2 is a cutaway view from the front of the chainsaw, and FIG. 3 is a cutaway view from the top of the chainsaw. In both embodiments, however, the cam cup 204 has a hole through which the anchor bolt 128 protrudes and a wall having a first portion 400 and a second portion 402. The first portion 400 of the cam cup 204 is to the left of the anchor bolt 128, and the second portion 402 is to the right of the anchor bolt 128.

In the embodiment shown in FIG. 2, the first portion 400 of the wall is identical to the second portion 402 in terms of thickness and shape. In the embodiment shown in FIG. 3, however, the first portion 400 of the wall is thinner than the second portion 402 of the wall, and the first side 404 of the cam cup adjacent to the first portion 400 is therefore shorter than the second side 406. In other embodiments, the cup 204 may have serrations or a portion cut out of it as long as it contacts the guide bar 102 at an angle.

In both embodiments the purpose of the cam cup 204 is to force the guide bar 102 to stay in place when the chainsaw is operating by pressing against it with the necessary amount of force. When a chainsaw is in operation, the guide bar 102 has a tendency to move back toward the user due to the rotational forces of the engine and chain 104. Having an angled cam cup 204 as shown FIG. 3, however, allows the cam cup 204 to hold the guide bar 102 in place using a lower load level on the cam cup 204. When the wall of the cup is flat, as in FIG. 2, the force on the guide bar 102 stays constant, and the bar will slip under extreme conditions and not revert to its original position. When an angled cup is pressed against the guide bar 102, as the bar 102 slips backward, the cup acts as a wedge and absorbs the force that would otherwise cause the bar 102 to move backward. The angled cup 204 also pushes back when the extreme condition is gone.

Figure 4:
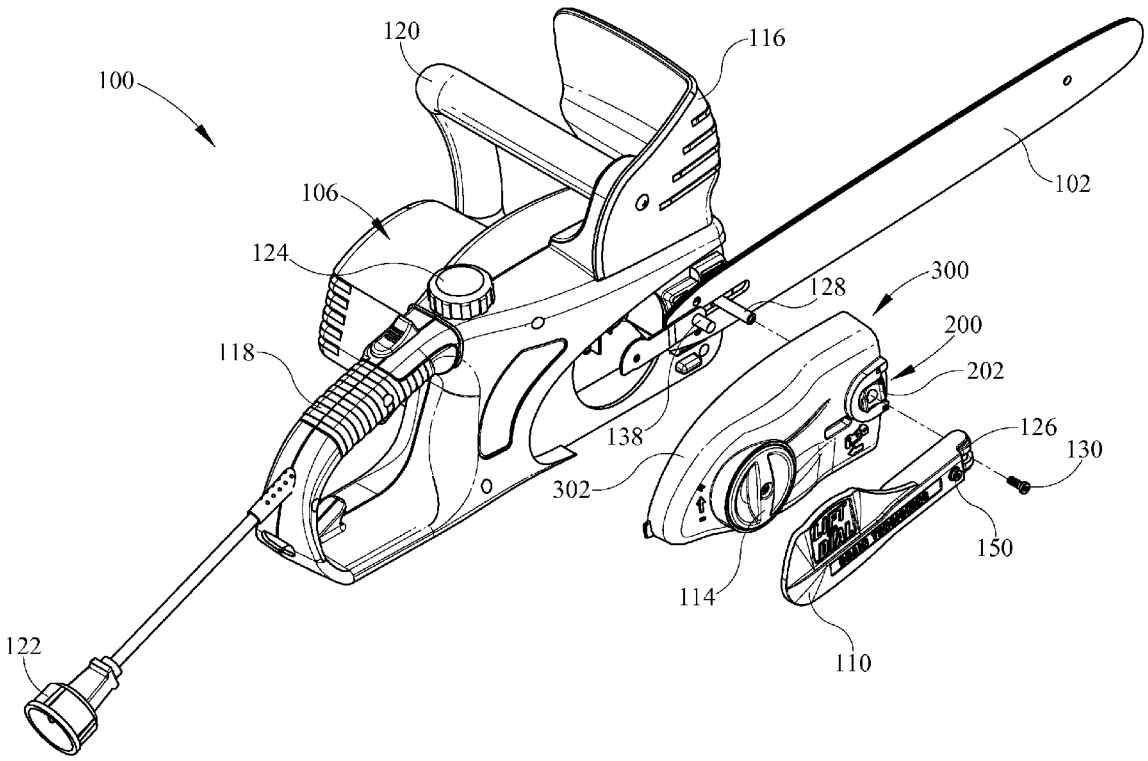
FIG. 4 is an exploded view of one embodiment of the invention.
Figure 5:
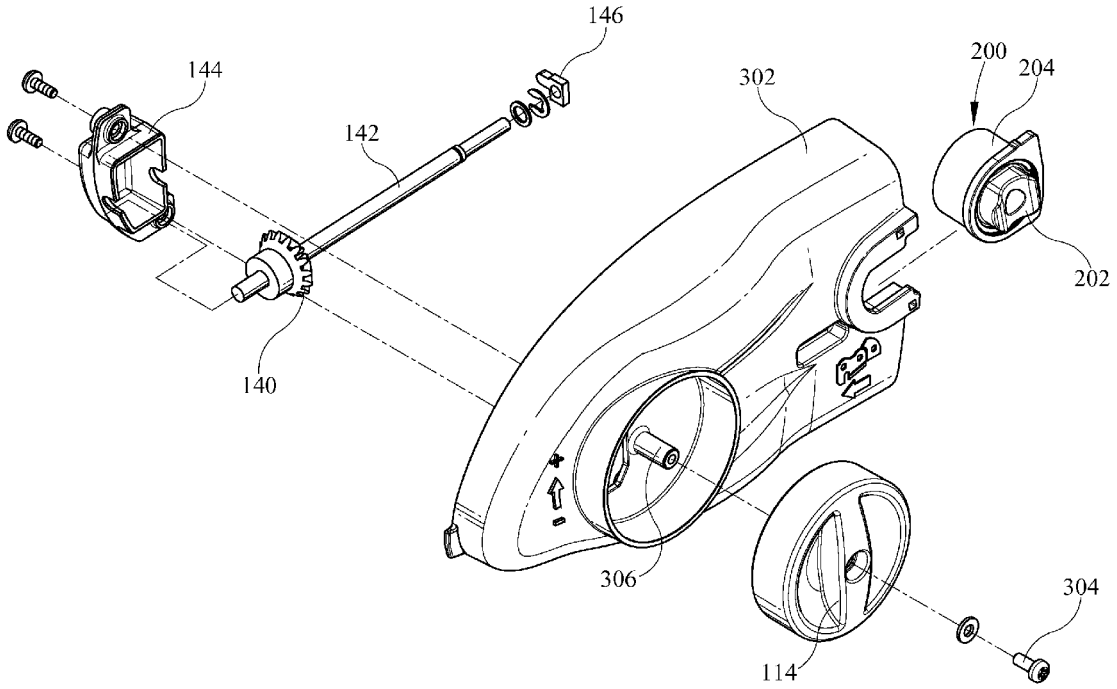
FIG. 5 is an exploded view of an embodiment of the sprocket cover sub-assembly of the invention.

Turning to FIG. 4, in one embodiment the chainsaw 100 has a sprocket cover sub-assembly 300. Also shown in FIG. 4 are a cam lever 110, a cam 126, and a pivot pin 134, which is more visible in FIG. 8. The sprocket cover sub-assembly 300 comprises a sprocket cover 302 with a chain-tightening knob 114, shown in FIG. 4. When the chain-tightening knob 114 is rotated, its movement translates to linear movement of the guide bar 102, which tightens the chain 104 around the guide bar 102. A cam follower 202, which is part of the cam cup assembly 200, is also positioned within the sprocket cover 302 (FIGS. 4 and 5). The cam follower 202 has a curved edge that interacts with the cam 126, as will further be discussed below.

As also shown in FIG. 1B, a cam screw 130 inserts through the cam 126, pivot pin 134, and cam cup 204 into the anchor bolt 128. Along with the anchor bolt 128, a dummy post 138 also protrudes through the guide bar 102. The dummy post 138 helps hold the guide bar 102 in place and prevents the guide bar 102 from rotating around the housing 106.

An exploded view of the sprocket cover sub-assembly 300 is shown in FIG. 5. A pan head screw 304 projects through a washer and into the chain-tightening knob 114 in the sprocket cover 302. A first gear (not shown) is attached to the back of a bolt 306 that connects to the chain-tightening knob 114. The bolt 306 rotates when the chain-tightening knob 114 rotates, and the first gear rotates simultaneously as well.

Still referring to FIG. 5, the first gear has a multitude of teeth (also not shown) that mesh with the teeth of a second gear 140. The second gear is connected to a tensioning screw 142 and covered by a gear cover 144. When the second gear 140 rotates, the tensioning screw 142 moves toward or away from the second gear 140 depending on the direction the chain-tightening knob 114 is rotated. For example, in the embodiment shown in FIG. 5, when the chain-tightening knob 114 is rotated clockwise, the second gear 140 rotates counterclockwise, and the tensioning screw 142 moves away from the second gear 140 and contacts an adjustment block 146. The adjustment block 146 is adjacent to the guide bar 102 and, its movement determines the movement of the guide bar 102.

Figure 6:
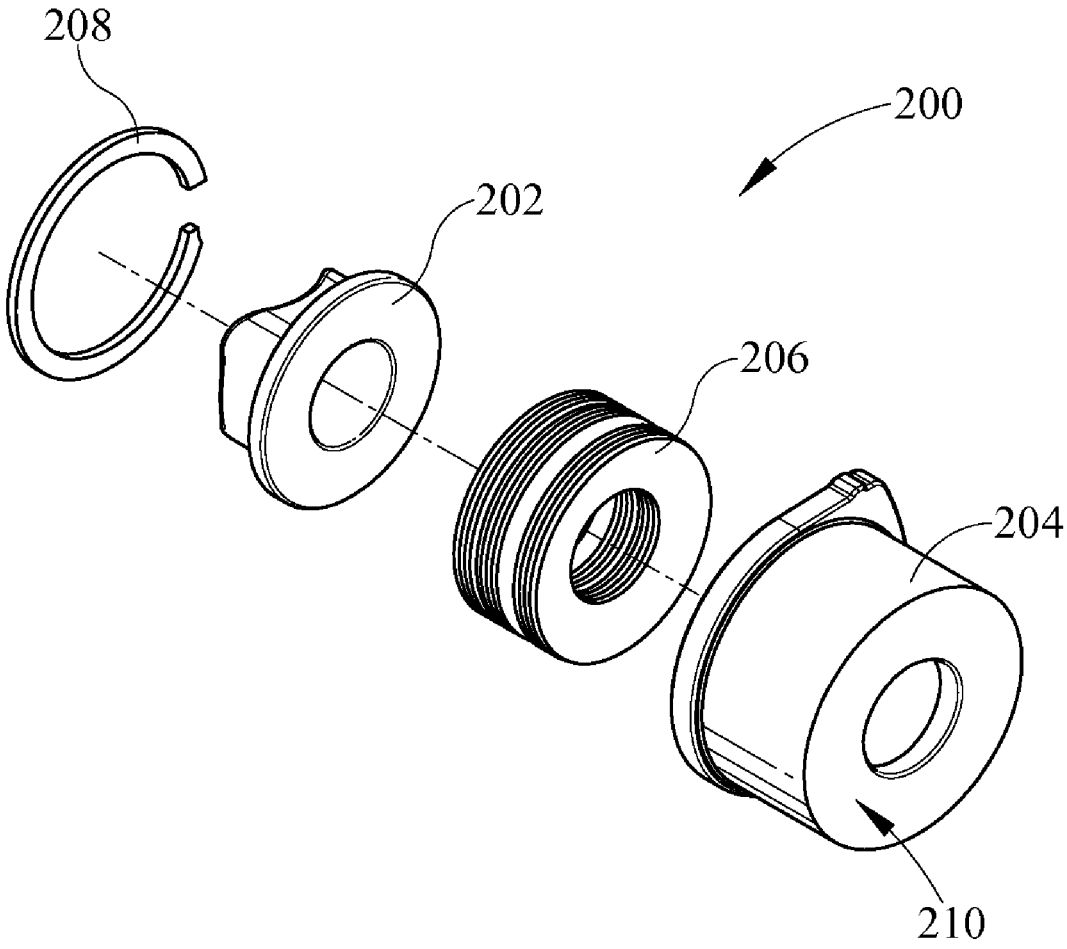
FIG. 6 is an exploded view of an embodiment of the cam cup assembly of the invention.

A cam cup assembly 200 is positioned within the sprocket cover 302, as shown in FIG. 5. An exploded view of the cam cup assembly 200 is shown in FIG. 6. In the embodiment shown in FIG. 6, the cam cup assembly 200 has a cam cup 204 into which other components are inserted. These components include a spring 206, a cam follower 202, and a retaining ring 208, which is not inserted into the cam cup 204 but instead locks into place on the outside edge of the cam cup 204 and holds the cam follower 202 and spring 206 in place. In the embodiment shown in FIG. 6, the spring 206 comprises a number of Belleville washers, but other types of springs, including compression springs, cantilever springs, or wave washers can be used. A first end 210 of the cam cup 204 is adjacent to the guide bar 102 (not shown in FIG. 5), and a curved surface of the cam follower 202 is in contact with the cam 126 (not shown in FIG. 6). The operation of the cam lever 110 and cam cup assembly 200 is shown more clearly in FIGS. 9-14 as discussed below.

Figure 7:
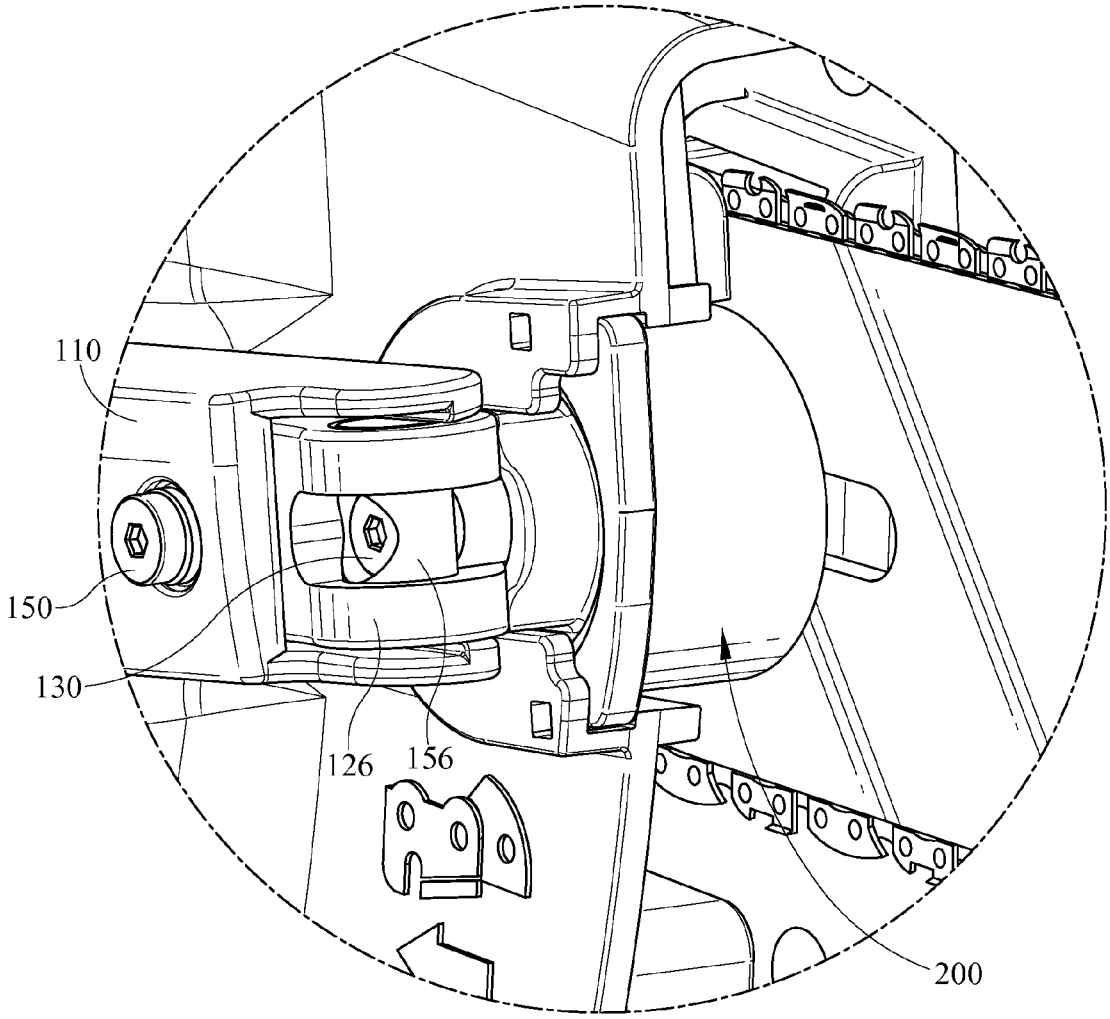
FIG. 7 is a close-up view of one embodiment of the cam cup assembly of the invention.
Figure 8:
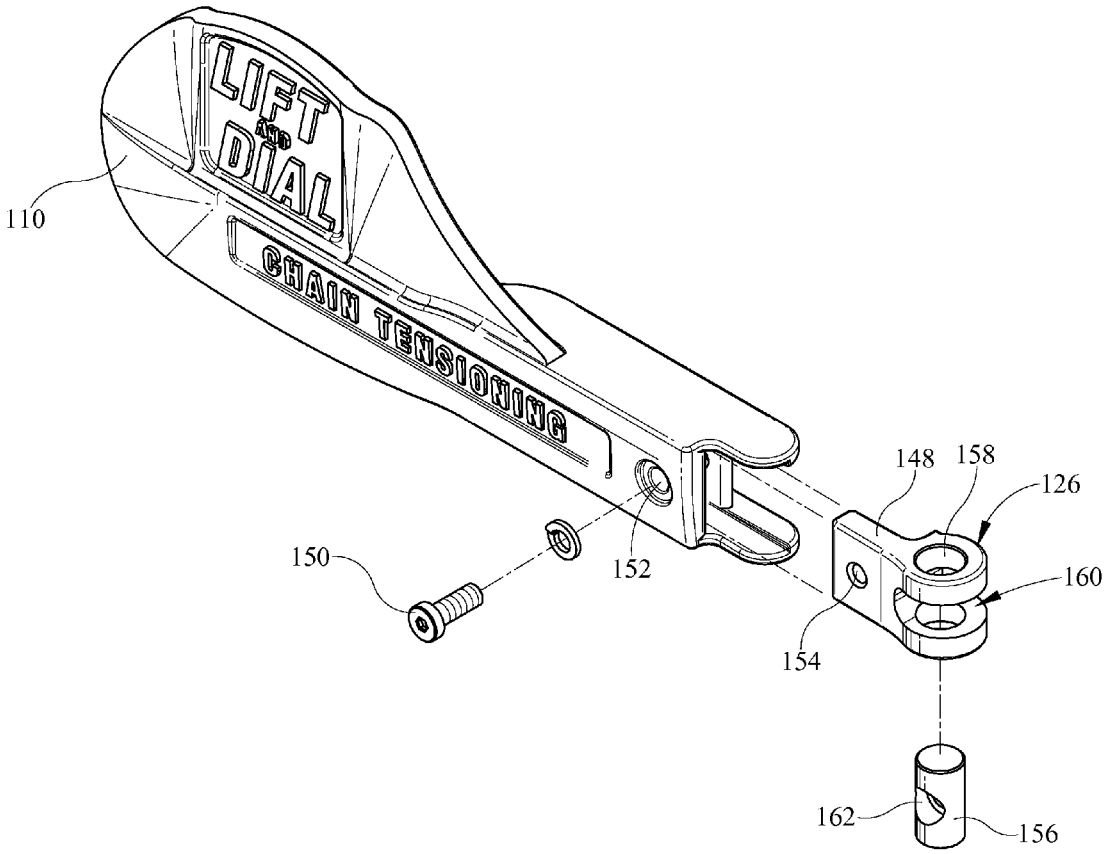
FIG. 8 is a cut-away view of the cam and cam lever assembly of an embodiment of the invention.

FIGS. 7 and 8 show the cam 126, cam lever 110, and cam cup assembly 200 in more detail. As shown in FIG. 8, the cam 126 has an elongated portion 148 that slides into the cam lever 110 and can be attached to the cam lever 110 by a cam lever screw 150 inserted through a first opening 152 on the cam lever 110 and a corresponding opening 154 on the elongated portion 148. The circular portion of the cam 126 sits in the cam lever 110 and has a vertical opening 158 and a first horizontal opening 160. A pivot pin 156 inserted in the vertical opening 158 has a second horizontal opening 162 for the cam screw 130. The cam screw 130 connects the cam 126 to the cam cup assembly 200. The cam lever 110 is held in place by a cam lever screw 150, and the cam cup assembly 200 is held in place by a cam screw 130. The cam screw 130 inserts into the anchor bolt 128, which helps to hold the guide bar 102 in place. The spring 206 is positioned in the cam cup 204, which is adjacent to the guide bar 102. The cam follower 202 is in direct contact with the cam 126 and spring 206.

Figure 9:
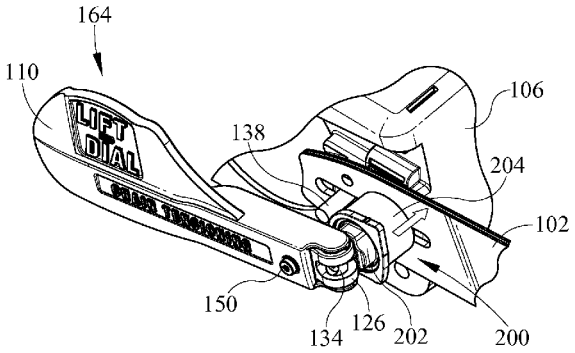
FIG. 9 is a perspective view of the cam lever in a first position.
Figure 10:
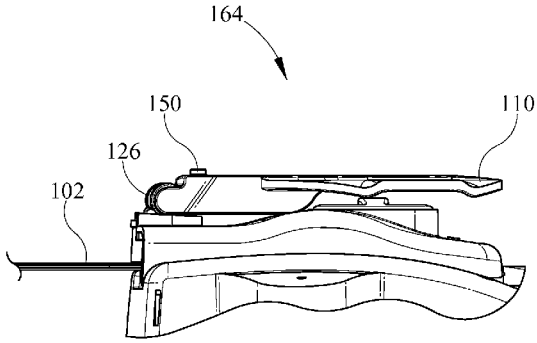
FIG. 10 is a top view of the cam lever in a first position.
Figure 11:
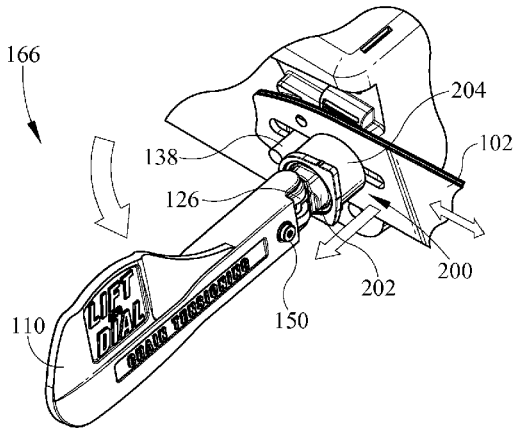
FIG. 11 is a perspective view of the cam lever in a second position.
Figure 12:
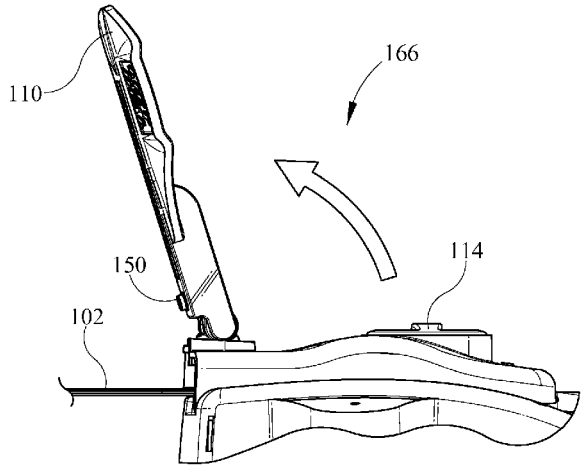
FIG. 12 is a top view of the cam lever in a second position.
Figure 13:
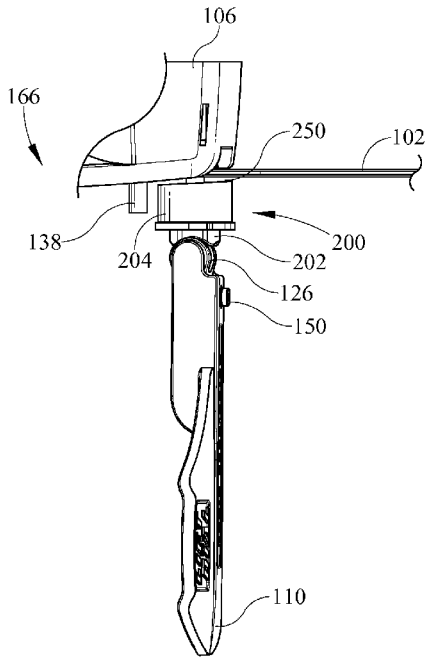
FIG. 13 is a top view of the cam lever in a second position.

As shown in FIGS. 9-14, the cam lever 110 can be moved from a first position 164 (FIGS. 9, 10, and 14) to a second position 166 (FIGS. 11-13). When the cam lever 110 moves from the first position 164 to the second position 166, the cam 126 rotates around the pivot pin 156, which is connected to the cam cup assembly 200 by the cam screw 130. The cam screw 130 thus remains stationary while the cam rotates. As the cam rotates, the surface of the cam 126 slides along the curved surface of the cam follower 202, which also remains stationary.

As visible in FIG. 8, the cam 126 itself is not perfectly circular, so the pressure on the cam follower 202 does not remain constant as the cam 126 rotates. The cam 126 is thickest at the spot where it comes in contact with the cam follower 202 when the cam lever 110 is in the first position 164. The thickness of the portion of the cam 126 in contact with the cam follower 202 decreases as the cam lever 110 moves from the first position to the second position 166. As a result, the pressure on the cam follower 202 decreases, and the spring 206 within the cam cup 204 decompresses partially.

Figure 14:
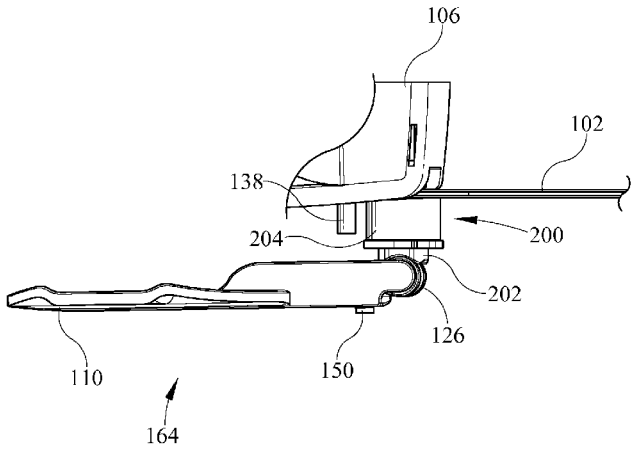
FIG. 14 is a top view of the cam lever in a first position.

When the cam lever 110 is in the first position 164, the cam cup 204 is tightly positioned against the guide bar 102 so that the guide bar 102 is tightly held in place, as shown in FIGS. 9 and 14. When the cam lever 110 is in the second position 166, the pressure on the cam cup 204 is less, and is the cam cup 204 is not pressed as tightly against the guide bar 102, as shown in FIGS. 11 and 13, and the pressure may be lessened enough to create a gap 250 between the cam cup 204 and the guide bar 102, as shown in FIG. 13. The chain-tightening knob 114 can then be used to adjust the position of the guide bar 102, as previously discussed.

To sum up the chain-tightening process of one embodiment of the invention, as previously stated, the cam follower 202 is in direct contact with the cam 126 and spring 206, and the cam follower 202 moves away from the guide bar 102 when the cam lever 110 is moved from a first position 164 to a second position 166. The cam follower moves toward the guide bar 102 when the cam lever 110 moves from the second position 166 to the first position 164. When the cam follower 202 moves away from the guide bar 102, the pressure on the spring 206 decreases, as does the pressure on the guide bar 102.

With the pressure decreased, the location of the guide bar 102 can then be adjusted with the chain-tightening knob 114 as previously discussed. To make the chain tighter, the guide bar can be moved forward, and to make the chain looser, the guide bar can be moved backward.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

The invention claimed is:

1. A chainsaw comprising:

a housing;

a power source positioned within said housing;

a guide bar partially enclosed within the housing and extending from said housing;

an endless chain wrapped around said guide bar and rotated by said power source;

a cam lever positioned outside said housing and movable between a first position and a second position;

a cam attached to said cam lever, wherein said cam rotates when said cam lever moves between said first position and said second position;

a spring positioned between said cam and said guide bar such that when said cam rotates, said spring moves closer or farther away from said guide bar, thereby adjusting the tension of the guide bar;

a rotatable chain-tightening knob on said housing and underneath said cam lever such that said chain-tightening knob is accessible when said cam lever is moved from said first position to said second position;

a gear within said housing that meshes with said chain-tightening knob; and a tensioning screw interacting with said gear and said guide bar, wherein rotation of said chain-tightening knob causes said guide bar to move.

2. The chainsaw of claim 1 wherein rotation of said chain-tightening knob rotates said gear, wherein said rotation of said gear moves said tensioning screw in relation to said guide bar.

3. The chainsaw of claim 2, wherein rotation of said gear moves said tensioning screw in relation to said guide bar such that said guide bar moves closer to said chain.

4. The chainsaw of claim 2 wherein rotation of said gear moves said tensioning screw in relation to said guide bar such that said guide bar moves away from said chain.

5. The chainsaw of claim 2 further comprising:

a cam cup adjacent to said cam and said guide bar;

a cam follower within said cam cup and adjacent to said at least one spring;

a retaining ring adjacent to said cam follower.

6. The chainsaw of claim 5, wherein said cam cup has a wall adjacent to said guide bar, wherein said wall has a first portion and a second portion on opposite sides of a anchor bolt, wherein said first portion of said wall is thinner than said second portion of said wall.

7. The chainsaw of claim 5, wherein said cam cup has a first side perpendicular to said guide bar and a second side perpendicular to said guide bar, wherein said first side is shorter in length than said second side.

8. The chainsaw of claim 5, wherein said cam cup has a serrated edge that contacts said guide bar.

9. The chainsaw of claim 5, wherein said cam cup has a wedge portion that contacts said guide bar.

10. The chainsaw of claim 5 further comprising:

a vertical opening and a central horizontal opening in said cam;

a pivot pin inserted in said vertical opening;

a horizontal opening in said pivot pin;

a screw inserted into said horizontal opening and extending through said pivot pin and said cam; and an anchor bolt adjacent said guide bar and opposite said cam, wherein said anchor bolt extends through said guide bar and secures said cam in alignment with said screw and on said guide bar.

* * * * *